United States Patent [19]

Fluck

[11] Patent Number: 4,913,342

[45] Date of Patent: Apr. 3, 1990

[54] STREET MAIL BOX SIGNAL DEVICE

[76] Inventor: Henry T. Fluck, 7735 Jolian Dr., Cincinnati, Ohio 45242

[21] Appl. No.: 267,813

[22] Filed: Nov. 7, 1988

[51] Int. Cl.[4] ..... B65D 91/00

[52] U.S. Cl. ..... 232/35

[58] Field of Search ..... 232/34, 35, 37

[56] References Cited

U.S. PATENT DOCUMENTS

| | | | |
|---|---|---|---|
| 1,149,781 | 8/1915 | Palmer . | |
| 1,671,520 | 5/1928 | Farrell . | |
| 1,742,128 | 12/1929 | Bond . | |
| 1,927,736 | 9/1933 | Davis et al. | 232/35 |
| 2,668,657 | 2/1954 | Horton | 232/35 |
| 2,782,983 | 2/1957 | Cyphers | 232/35 |
| 2,905,378 | 9/1959 | Cox et al. | 232/35 |
| 3,168,239 | 2/1965 | Cooper | 232/35 |
| 3,581,980 | 6/1971 | Kreycik | 232/35 |
| 4,570,846 | 2/1986 | Morgrey | 232/35 |

*Primary Examiner*—Robert P. Swiatek

*Attorney, Agent, or Firm*—Charles R. Wilson

[57] ABSTRACT

A mail box signal device article is adapted for ready installation to a street mail box. The article comprises a housing for holding the components of the device, with the housing itself attached to the mail box. Mounted on the housing is a hub assembly comprised of an axle which extends through a side wall of the housing, a first disc rotatably mounted on the axle within the housing and a second disc rotatably mounted on the axle outside of the housing. The two discs rotate together. An arm extends from the first disc and has a lateral pin extending at a right angle from one extremity. A slide link with an elongated slot is slidably connected with the lateral pin of the arm. A bracket pivotably attached to one extremity of the slide link is intended for permanent mounting to a door of the mail box. A signal is fixedly attached to the second disc of the hub assembly. The signal is moved to a vertical position when the door is opened and remains there until disengaged by the owner.

13 Claims, 2 Drawing Sheets

STREET MAIL BOX SIGNAL DEVICE

This invention relates to a signal device article for use on street mail boxes. More particularly the invention relates to a signal device article which is capable of ready attachment to a street mail box and which operates automatically upon opening of the mail box door.

BACKGROUND OF THE INVENTION

Street mail boxes are well known and are widely used. At one time they were predominately used in rural areas. However, recent postal regulations have required that new homes have a street mail box positioned along side a roadway. The mail boxes are positioned close enough to the roadway that mail can be placed in them by a mail carrier from his vehicle. Residents with street mail boxes quite often do not know if the mail has been delivered unless their mail carrier has a very strict time schedule or unless they happen to see the mail carrier at the instant the delivery is made. More often than not the resident is required to walk to the mail box and inspect its interior.

There has long been a need for a simple yet convenient device which can effectively signal the mail box owner as to the delivery of mail. Several different mail box signal devices have been devised. Examples of such signal devices can be found in U.S. Pat. Nos. 1,149,781; 1,742,128; 2,782,983; and 2,905,378. A common disadvantage with many of the known mail box signal devices is that they are relatively complex. They easily break or readily become inoperable. A particular problem with known signal devices used in northern climates is that they are prone to not work in freezing rains and snows. Still another drawback with known signal devices is that they are difficult to install on a mail box. Street mail boxes are normally made of sheet metal. Most signal devices require that a number of drill holes be made into the box. The holes must be precisely located or the devices will not attach properly and work properly.

There is still a need for an improved street mail box signal device. Initially such a device must be easy to install. Additionally the device must be easy to operate under a wide variety of weather conditions. Ideally the device will have a minimum number of working components so as to minimize working problems. The device must also be automatic in operation so as to be effective and acceptable.

SUMMARY OF THE INVENTION

A mail box signal device article has been devised which is readily adapted for installation on a street mail box. The article comprises a housing which holds all of the working components of a signal means. The housing itself is adapted for attachment to the side of the mail box. Associated with the housing is a hub assembly comprising an axle extending through a side of the housing with a first disc rotatably mounted on the axle within the housing and a second disc rotatably mounted on the axle outside of the housing. The discs are mounted so as to rotate together. The first disc has an arm with a lateral pin at its non attached extremity. A slide link having an elongated slot near a first extremity is in operable association with the arm of the hub assembly. A bracket, pivotably attached to the second extremity of the slide link, is capable of attachment to the mail box door. The assembly also comprises a signal means having a flag and a staff wherein the staff is attached to the second disc mounted on the axle. Opening of the mail box door causes the slide link to pull the arm forwardly, which in turn causes the discs of the hub assembly to rotate. The rotational movement of the outside disc causes the signal means to rise from a rest position to an upright signaling position. Closing of the mail box door does not disturb the position of the signal means.

DETAILED DESCRIPTION OF THE INVENTION

Figure 1:
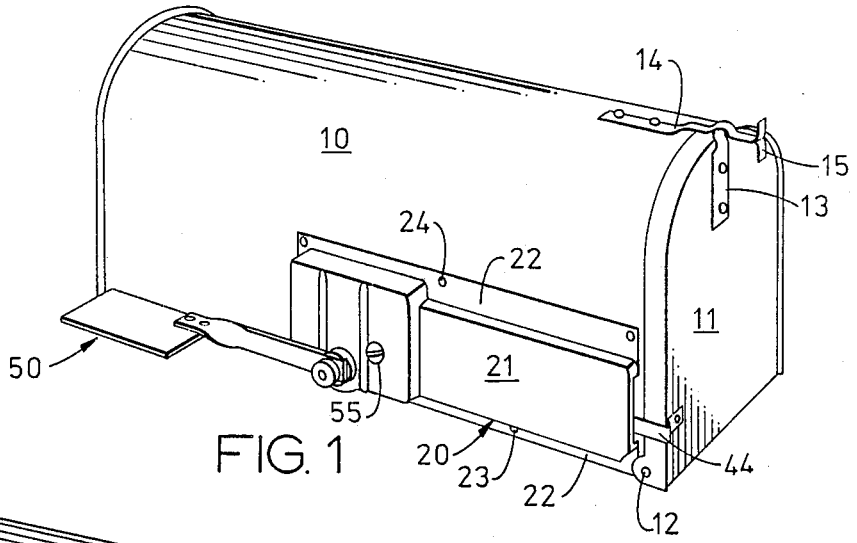
FIG. 1 is a view in perspective showing the mail box signal device of this invention attached to a side of a mail box.
Figure 2:
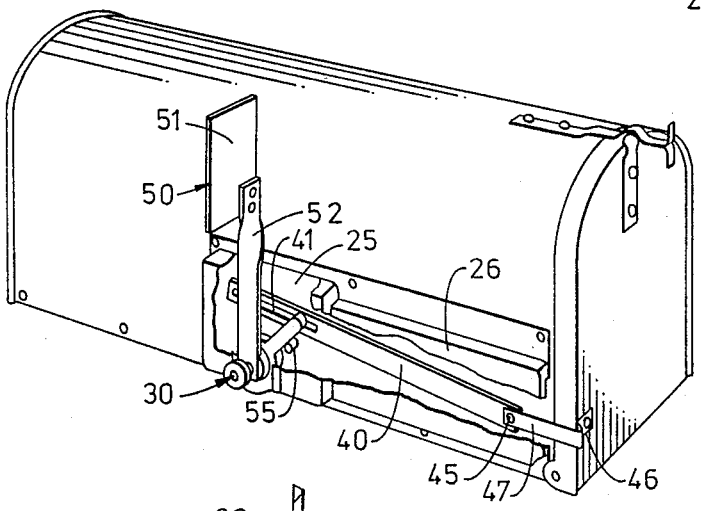
FIG. 2 is a view in perspective of the signal device and mail box of FIG. 1 with a partial cut away of the housing illustrating when the signal means is in an upright position thereby signaling the fact that the door has been opened and mail inserted therein.

The signal device article on this invention is intended for use on street mail boxes. Such mail boxes are conventional and are widely used. With reference to FIGS. 1 and 2, a typical street mail box comprises a box 10 with a door 11 hingably attached by pivot hinge means 12 to one end of the box. A latch means is comprised of a catch 13 positioned on the outside of the door and a mating keeper means 14 attached on a top portion of the box. Finger piece 15 extending from catch 13 aids in opening and closing of the door. The door is so constructed that it can be rotated about its hinges and latched by the keeper means in a semipermanent closed position. Mail is placed in the box simply by swinging the door open about its hinges, placing the mail within the box, and closing the door. The mail box itself is generally positioned about four feet off the ground and on a post near a curb of a roadway.

The signal device article on this invention is adapted for ready attachment to the outside surface of the aforedescribed street mail box. A housing 20 is dimensioned to fit onto a side of the street mail box and to hold the working components of the signal device. Normally, the housing will attach to the left side of the box when looking from the door end. An elongated base portion 21 has flanges 22 on at least two sides. A series of spaced holes 23 are found in the lower flange portion to match with holes pre-drilled into most commercially available street mail boxes. The pre-drilled holes are normally provided as an aid in mounting the box on a post and platform. More often than not all the pre-drilled holes are not used and thus available for use with the signal device article. Holes 24 in the upper portion of the housing's flange are needed to properly position and attach the housing and in fact will necessitate the drilling of matching holes in the street mail box. When attached to the mail box, the housing in effect shelters the working components from rain and snow.

Figure 3:
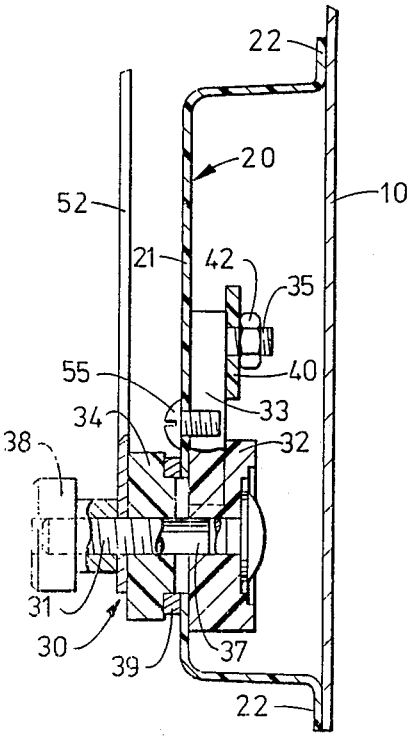
FIG. 3 is an end view showing the hub assembly of the signal device article of FIG. 1.

As evident from FIGS. 2 and 3, the housing 20 has an open-sided back. The back could as well be closed, though provides no real advantage and does hamper the assembly of the article by the manufacturer. Recessed portions 25 and 26 in the housing are to accommodate the article's working components. The depths of the recesses are determined by the working component dimensions and are coordinated for ease of operation of the signal device article.

A hub assembly shown generally as 30 is mounted on the housing. The assembly is comprised of an axle 31, a first disc 32, an arm 33 extending from the first disc and a second disc 34. Axle 31 extends through the housing's elongated base portion side wall. Rotatably mounted on one end of the axle 31 is first disc 32. The arm 33 extending from an outer edge of the disc is secured thereto by conventional attachment means or, as shown, is unitary in structure with the disc. Preferably, the arm and disc are formed out of plastic from a mold and are thus unitary. The arm is further characterized in having a threaded lateral pin 35 extending at a right angle from an outer extremity.

Figure 4:
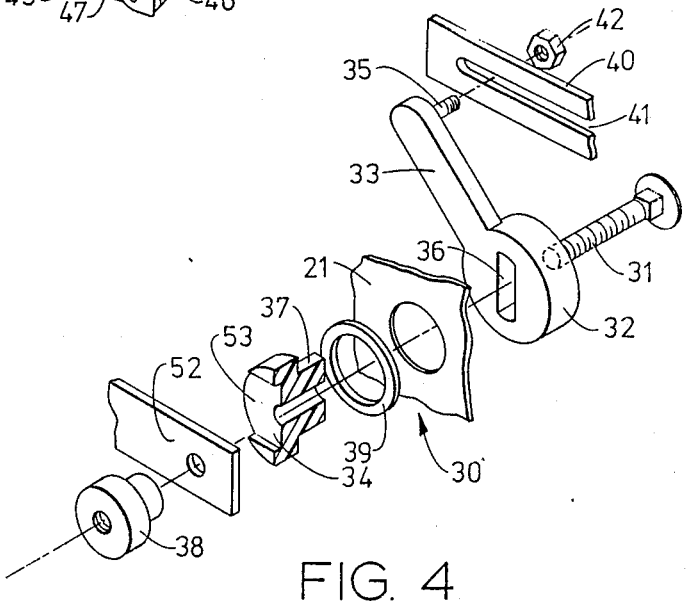
FIG. 4 is an exploded view of the hub assembly of FIG. 3.

A second disc 34 is also rotatably mounted on axle 31. Discs 32 and 34 are mounted in a manner such that they rotate together about axle 31. Preferably, as evident in FIG. 4, first disc 32 has a central recess 36 and second disc 34 has a central protrusion 37. The protrusion which extends through the hole in the housing mates with the recess and in effect locks the two discs together. A locking knob 38 threaded onto the end of axle 31 holds the hub assembly together. A friction washer 39 is optionally used between disc 34 and the housing's side wall to steady the signal means during operation.

A slide link 40 in operable association with arm 33 of the hub assembly 30 extends substantially the length of the housing. An elongated slot 41 is positioned near one extremity and runs lengthwise along the bar. As apparent in FIG. 3, lateral pin 35 of arm 33 extends through the slot 41 and is held in slidable connection by nut 42.

Attached at an outer extremity of the slide link 40 is a bracket 44 with legs 46 and 47. This bracket is pivotably attached by pivot pin 45 to the slide link. Leg 46 of the bracket extends at a right angle from leg 47. A hole is provided in leg 46 to accommodate a screw for attachment to the box's door.

The lengths of arm 33, slide link 40, elongated slot 41 and bracket leg 47 are interdependent and important to the proper operation of the signal means. When the door of the mail box is initially opened, the slide link must be forced to travel forwardly by the engagement of the back edge of the elongated slot to the lateral pin 35 of the arm. This will cause the arm's movement and discs' movement. Yet when the door is closed, the slide link must be able to travel backwardly without causing any arm or disc movement.

Arm 33 has a length such that when positioned at about forty-five degrees backward and about forty-five degrees forward of the vertical it will be contained within the housing. Total length of slide link 40 and bracket leg 47 (when substantially at one hundred and eighty degrees with the slide link) is such that a back edge of the slide link abuts against the housing's back wall and the non-pivot end of leg 47 is substantially even with the closed door of the mail box. Thus, when the door is closed and the signal means is in a horizontal position, the arm 33 is about forty-five degrees backward of vertical and the back edge of the slide link abuts the housing's back wall. When the door is opened, the arm travels about ninety degrees to now be about forty-five degrees forward of vertical. Additionally, the bracket leg 47 pivots to be substantially ninety degrees to the slide link and substantially ninety degrees to the opened door.

The length of elongated slot 41 and its position in the slide link 40 are also important. A back edge of the slot must engage lateral pin 35 of arm 33 when the door of the mail box is closed and the signal means is in a horizontal position (see FIG. 5). The slot's front edge must extend along the slide link a distance sufficient enough that the lateral pin will not engage the slot's front edge when the door is first opened to raise the signal means and thereafter the door is closed (see FIG. 2). Generally, the elongated slot is a length such that when the arm is at a substantially forty-five degrees to the backward position it will engage the back edge of the slot and when the arm is at a substantially forty-five degrees to the forward position it will engage the front edge of the slot. An elongated slot length of from about one and one-half inches to about three inches is typical.

Signal means 50 is comprised of a flag 51 and a staff 52. Staff 52 is fixedly attached to second disc 34 of the hub assembly. Preferably, as shown best in FIG. 4, a slot 53 extends through the center portion of the outer surface of second disc 34. The width of the slot is dimensioned to snugly hold staff 52. Knob 38 threaded onto the end of axle 31 holds the staff 52 in proper alignment and spacing relative to the housing's side wall. Alternatively, the staff of the signal means can be attached to the second disk by adhesive means, threaded or forced fit into a receiving hole on the disc's edge, or any other conventional attachment method.

Flags of various shapes and dimensions can be used. For example, a flag comprised of two flat portions at right angles to each other can be used for enhanced viewing purposes. Various paints also can be used on the flag for easier viewing or perhaps aesthetic reasons.

In a preferred embodiment, a safety stop is provided on the housing to prevent arm 33 from rotating too far. Thus, machine screw 55 extends through the housing's side wall at a point where the arm 33 will engage it in a forward position when at substantially forty-five degrees from the vertical. Without the safety stop, excessive downward force on door 11 could force arm 33 to over rotate and cause the slide link to not properly move.

Preferably, the signal device article is completely assembled and ready for attachment by screws to a mail box. For packaging reasons, the signal means can be detached and added to the hub assembly by the consumer.

For installation purposes, the holes found on the housing's lower flange are aligned with pre-drilled holes found on the conventional street mail box. Next, markings are made on the box using the holes in the upper flange and drilled. Machine screws with cap nuts are used to permanently attach the housing to the mail box. The final step of installation requires the bracket attached to the slide link to be permanently affixed to the mail box's door. Normally some adjustment of the bracket to the door will be required for optimum performance. Routine experimentation will readily ascertain the precise location on the door to receive the bracket.

Figure 5:
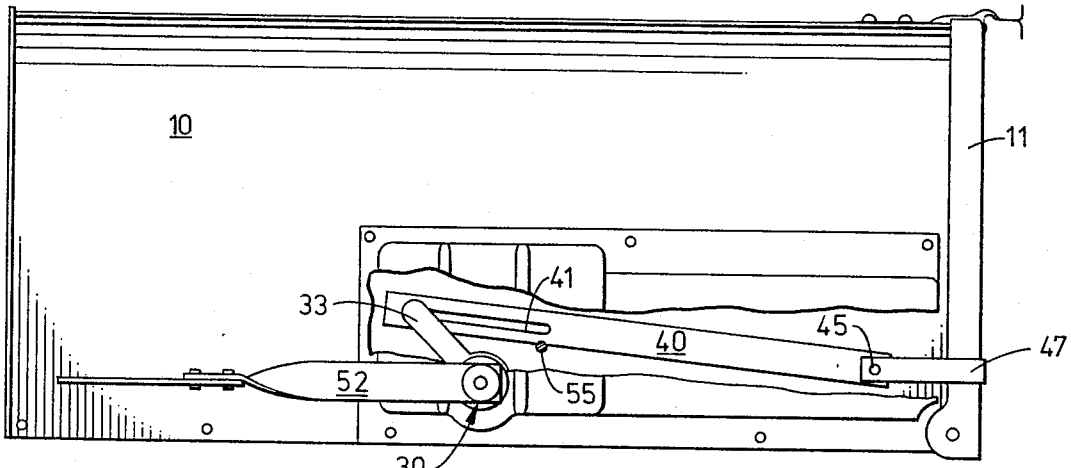
FIG. 5 is a side view of the signal device article of FIG. 1 with a partial cut away of the housing showing the signal device in a rest position.
Figure 6:
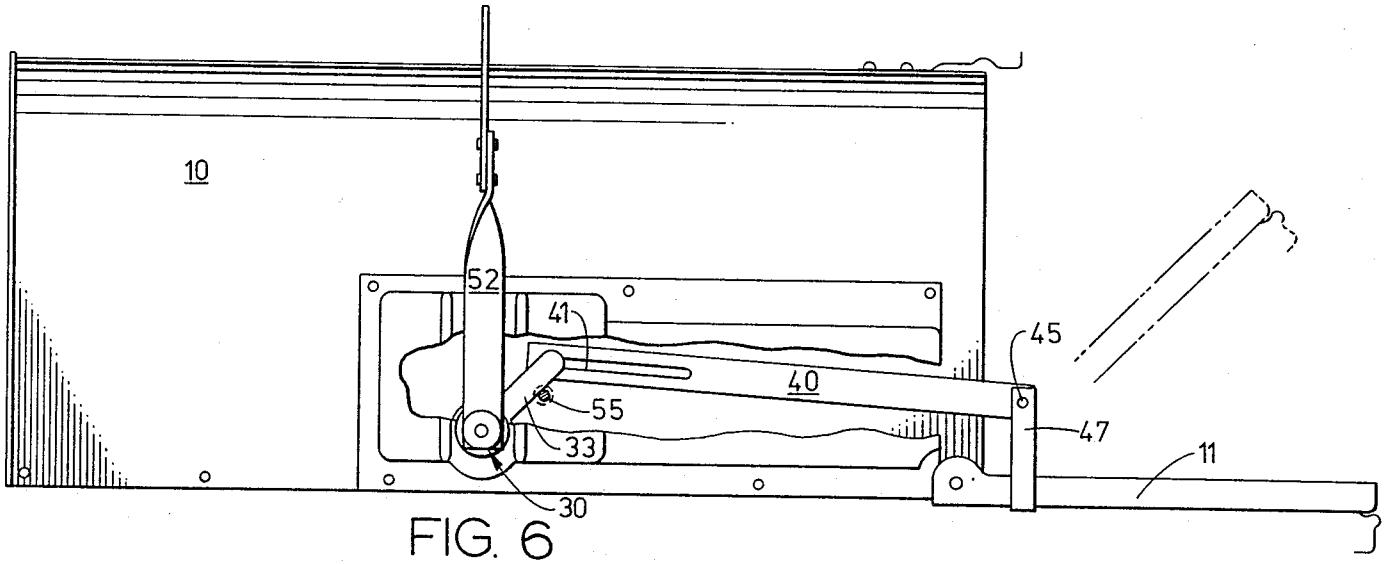
FIG. 6 is a side view, with a partial cut-away and partly in phantom, showing the operation of the signal device article of FIG. 1 when the mail box door is in an open position and a closed position.

In operation and with reference to FIGS. 5 and 6, the signal means is moved downwardly to be in a horizontal or rest position and the door closed. When the door is opened, the bracket is caused to follow the door by pivoting about its pivot point. This pulls the slide link forward. The back edge of the elongated slot in the slide link engages the lateral pin found on the arm to move it forward also. Since the arm is mounted on a fixedly mounted disc, movement of the arm forwardly causes the first disc to rotate about its axle. This in turn causes the second disc to rotate about its axle and bring the signal means in an arcuate path from its rest position to a vertical or fully upright position. Mail is placed in the box and the door closed. The bracket and slide link will move. However, because of the unique construction of the components, the slide link will slide along the arm's lateral pin but will not actually move it. In effect, the backward motion of the slide link is lost. As a result of this, the signal means remains in a vertical position. The owner of the mail box is alerted to the fact mail has been delivered. After opening the door to the mail box and removing the mail, the door is closed by moving the signal means to a horizontal position. So moving the signal means will cause the discs to rotate and the lateral pin to engage an edge of the elongated slot of the slide link and pull the door closed. The lateral pin remains engaged with the back edge of the elongated slot when the signal means is horizontal and thus is ready for use. No special steps are required of the mail carrier or the owner in setting or resetting the signal means.

While the invention has been described with particular reference to the drawings, it should be understood obvious variations and modifications can be made. Such changes are within the scope of the claims.

What is claimed is:

1. A mail box signal device article adapted for ready installation to a street mail box to signal when the mail box's door has been opened, said article comprising:

(a) a housing for attachment to a side of the mail box;

(b) a hub assembly mounted on the housing, said assembly having an axle extending through a side wall of the housing with a first disc rotatably mounted on the axle within the housing and a second disc rotatably mounted on the axle outside of the housing such that the first and second discs rotate together, further wherein an arm is fixedly attached to the first disc, said arm having a lateral pin at one extremity;

(c) a slide link in operable association with the hub assembly, said slide link having an elongated slot near a first extremity through which the lateral pin found on the arm is slidably connected whereby movement of the slide link will cause the arm to move in an arcuate path and the discs to rotate;

(d) a bracket pivotably attached to a second extremity of the slide link, said bracket capable of attachment to the mail box door in a manner such that opening or closing the door will cause the bracket to move the slide link; and (e) a signal means having a flag and staff, said staff fixedly attached to the second disc mounted on the axle outside of the housing, so as to move in an arcuate path when the mail box door is opened or closed.

2. The signal device article of claim 1 wherein the first disc of the hub assembly and the arm extending therefrom is unitary in structure.

3. The signal device article of claim 2 wherein the second disc has a central protrusion which extends through the housing wall and the first disc has a central recess to receive the central protrusion of the second disc to lock said discs together.

4. The signal device article of claim 3 wherein the axle of the hub assembly is a bolt with threads on the portion which passes through the second disc and said hub assembly further comprises a knob for threading onto the bolt to hold the first disc and second disc in a fixed position.

5. The signal device article of claim 4 wherein the second disc is further characterized in having a slot extending through one surface and the staff of the signal means has a width which snugly fits into the slot to hold said signal means fixedly to the disc.

6. The signal device article of claim 5 wherein the elongated slot on the slide link is from about one and one-half inches to about three inches in length.

7. The signal device of claim 6 wherein the housing has a recessed portion to accommodate the first disc and arm of the hub assembly and a second recessed portion to accommodate the slide link and bracket, wherein the second recessed portion is more shallow than the first recessed portion and acts as a guide in operation of the device.

8. The signal device article of claim 7 wherein the housing has flanges on at least two edges and a series of holes along the flanges, said holes for the purpose of receiving screws for ready attachment of the housing to the street mail box.

9. The signal device article of claim 1 wherein the first disc of the hub assembly and the arm extending therefrom are separate structures with said arm fixedly attached to the first disc.

10. The signal device of claim 1 further comprising a friction washer positioned on the axle and between the second disc and the housing, said friction washer to steady the signal means during operation.

11. The signal device of claim 10 further comprising a safety stop on the housing positioned to be engaged by the arm in the forward position when the arm is at about forty-five degrees from the vertical.

12. The signal device of claim 1 wherein the arm has a length such that it is contained within the housing when about forty-five degrees backward and forward of the vertical and further wherein the lateral pin on the arm can engage the back edge of elongated slot when the arm is substantially forty-five degrees to the backward of vertical and can engage the front edge of the elongated slot when the arm is substantially forty-five degrees to the forward of vertical.

13. The signal device of claim 1 wherein the flag of the signal means is comprised of two flat portions at right angles to each other, whereby said flag is more visible from any direction.

* * * * *